US008427399B2

(12) United States Patent
Lee

(10) Patent No.: US 8,427,399 B2
(45) Date of Patent: Apr. 23, 2013

(54) ORGANIC LIGHT EMITTING DISPLAY DEVICE INCLUDING SIGNAL PROCESSOR FOR MODIFYING IMAGE DATA AND DRIVING METHOD THEREOF

(75) Inventor: Jae-sung Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 847 days.

(21) Appl. No.: 12/170,765

(22) Filed: Jul. 10, 2008

(65) Prior Publication Data

US 2009/0040151 A1 Feb. 12, 2009

(30) Foreign Application Priority Data

Aug. 8, 2007 (KR) ..... 10-2007-0079527

(51) Int. Cl.
*G09G 3/30* (2006.01)

(52) U.S. Cl.
USPC ..... 345/76; 345/82

(58) Field of Classification Search ..... 345/36, 345/39, 45, 76–83
See application file for complete search history.

(56) References Cited

U.S. PATENT DOCUMENTS

| | | | | |
|---|---|---|---|---|
| 2002/0039087 | A1* | 4/2002 | Inukai | 345/76 |
| 2005/0264549 | A1* | 12/2005 | Mizumaki | 345/204 |
| 2006/0055710 | A1* | 3/2006 | Lo et al. | 345/629 |
| 2006/0208974 | A1* | 9/2006 | Hara | 345/76 |

FOREIGN PATENT DOCUMENTS

| | | |
|---|---|---|
| JP | 01-184525 | 7/1989 |
| JP | 08-314430 | 11/1996 |
| JP | 2004-126609 | 4/2004 |
| JP | 2006-148561 | 6/2006 |
| JP | 2006-243454 | 9/2006 |
| JP | 2006-267140 | 10/2006 |
| JP | 2006-337997 | 12/2006 |
| KR | 1992-4293 | 6/1992 |
| KR | 2004-80364 | 9/2004 |
| KR | 2006-114638 | 11/2006 |
| KR | 2006-120643 | 11/2006 |

OTHER PUBLICATIONS

Office Action issued by the Korean Patent Office on Sep. 22, 2008.
JP Office action dated Mar. 27, 2012 relating to JP Application No. 2007-251709, 2 pages.

* cited by examiner

*Primary Examiner* — Chanh Nguyen
*Assistant Examiner* — Sanghyuk Park
(74) *Attorney, Agent, or Firm* — Christie, Parker & Hale, LLP

(57) ABSTRACT

A controller to reduced power consumption and/or improve outdoor visibility of an organic light emitting display device, and an organic light emitting display device includes the same. The organic light emitting display device including: a light sensor to generate light sensing signals corresponding to an external light intensity; an image judging unit to generate image judging signals, by judging whether images generated by the data signals are moving images or still images; a signal processor to compare the light sensing signals with preset reference values, to generate selection signals, and to modify image data accordingly; a frame memory to store the image data from the signal processor; and a reset signal driver to reset the frame memory according to the image judging signals and the selection signals.

12 Claims, 5 Drawing Sheets

FIG. 5A $$A\begin{bmatrix} R_{in} \\ G_{in} \\ B_{in} \end{bmatrix} = \begin{bmatrix} R_s \\ G_s \\ B_s \end{bmatrix}$$

FIG. 5B $$A = \begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}$$

FIG. 5C $$\begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}\begin{bmatrix} R_{in} \\ G_{in} \\ B_{in} \end{bmatrix} = \begin{bmatrix} R_s \\ G_s \\ B_s \end{bmatrix}$$

FIG. 5D $$\begin{bmatrix} 0.299 & 0.587 & 0.114 \\ 0.299 & 0.587 & 0.114 \\ 0.299 & 0.587 & 0.114 \end{bmatrix}\begin{bmatrix} R_{in} \\ G_{in} \\ B_{in} \end{bmatrix} = \begin{bmatrix} R_s \\ G_s \\ B_s \end{bmatrix}$$

ORGANIC LIGHT EMITTING DISPLAY DEVICE INCLUDING SIGNAL PROCESSOR FOR MODIFYING IMAGE DATA AND DRIVING METHOD THEREOF

CROSS-REFERENCE TO RELATED APPLICATION

This application claims the benefit of Korean Application No. 2007-79527, filed Aug. 8, 2007, in the Korean Intellectual Property Office, the disclosure of which is incorporated herein by reference.

BACKGROUND OF THE INVENTION

1. Field of the Invention

Aspects of the present invention relate to an organic light emitting display device and a driving method thereof, and more specifically, to an organic light emitting display device, and a driving method thereof, capable of improving visibility.

2. Description of the Related Art

Recently, various flat panel display devices having reduced weight and size, which are disadvantages of cathode ray tubes, have been developed. A flat panel display device can be classified as a liquid crystal display (LCD), a field emission display (FED), a plasma display panel (PDP), and an organic light emitting display (OLED), etc.

An organic light emitting display device displays an image using an organic light emitting diode (OLED), which generates light by the recombination of electrons and holes (positively charged particles).

The market for such an organic light emitting display device, which has excellent color reproduction and reduced thickness, has been expanded to portable display devices, including PDA, MP3, DSC, and cellular phone devices.

However, since the organic light emitting display device emits light, according to a variation in the amount of current applied thereto, it consumes a large amount of current when emitting bright light. Therefore, in order to apply the organic light emitting display device to various displays, a reduction of the power consumption is sought.

In order to reduce the power consumption of the organic light emitting display device, by lowering only a driving voltage for an image as a whole, the brightness of darker portions of an image is also reduced, such that overall image quality is reduced.

Also, portable display devices, using the organic light emitting display device, are exposed to various environments. Therefore, the visibility of images displayed on the portable display device may be varied, according to the surrounding environment (surrounding luminance, etc). In particular, the visibility of images displayed on the portable display device may be suddenly degraded, when exposed to sunlight that is brighter than the brightness of image.

Therefore, a need exists for the development of an organic light emitting display device that is capable of improving its visibility, according to the surrounding environment.

SUMMARY OF THE INVENTION

It is an aspect of the present invention to provide a controller to reduce power consumption and/or improve outdoor visibility, according to user demands, and an organic light emitting display device including the same.

Aspects of the present invention relate to an organic light emitting display device including: a pixel unit having a plurality of scan lines to transfer scan signals; a plurality of data lines to transfer data signals, and a plurality of pixels, each coupled to the scan lines and the data lines. The organic light emitting display can include: a light sensor to generate light sensing signals corresponding to external light intensity; an image judging unit to generate image judging signals, by judging whether the images generated by the data signals are moving images or still images; a signal processor to compare the light sensing signals with preset reference values, to generate selection signals, and to modify input image data, according to the selection signals; a frame memory to receive and store the image data from the signal processor; a reset signal driver to generate reset signals to reset the frame memory, in accordance with the image judging signals and the selection signals; a scan driver to sequentially generate the scan signals, and to apply the scan signals to the plurality of scan lines; and a data driver to generate the data signals, and to apply the data signals to the plurality of data lines.

According to aspects of the invention, there is provided an organic light emitting display including: a pixel unit having a plurality of scan lines to transfer scan signals; a plurality of data lines to transfer data signals; and a plurality of pixels, each coupled to the scan lines and the data lines. The organic light emitting display can include: a switch unit to generate switch signals; a signal processor to generate selection signals, according to received switch signals, and to modify image data according to the selection signals; a frame memory to receive and store the image data when output from the signal processor; a reset signal driver to generate reset signals to reset the frame memory, according to the switch signals; a scan driver to sequentially generate the scan signals, and to apply the scan signals to the plurality of scan lines; and a data driver to generate the data signals, and to apply the data signals to the plurality of data lines.

According to aspects of the invention, there is provided a driving method of an organic light emitting display, the method including: resetting a frame memory storing input image data; changing pixel saturation and brightness values of image data, in response to a signal; and storing the changed image data in the frame memory.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which:

FIGS. 5A to 5D illustrate exemplary target saturation data per sub-pixel, using saturation change matrixes shown in FIGS. 2 and 4.

DETAILED DESCRIPTION OF THE EXEMPLARY EMBODIMENTS

Figure 1:
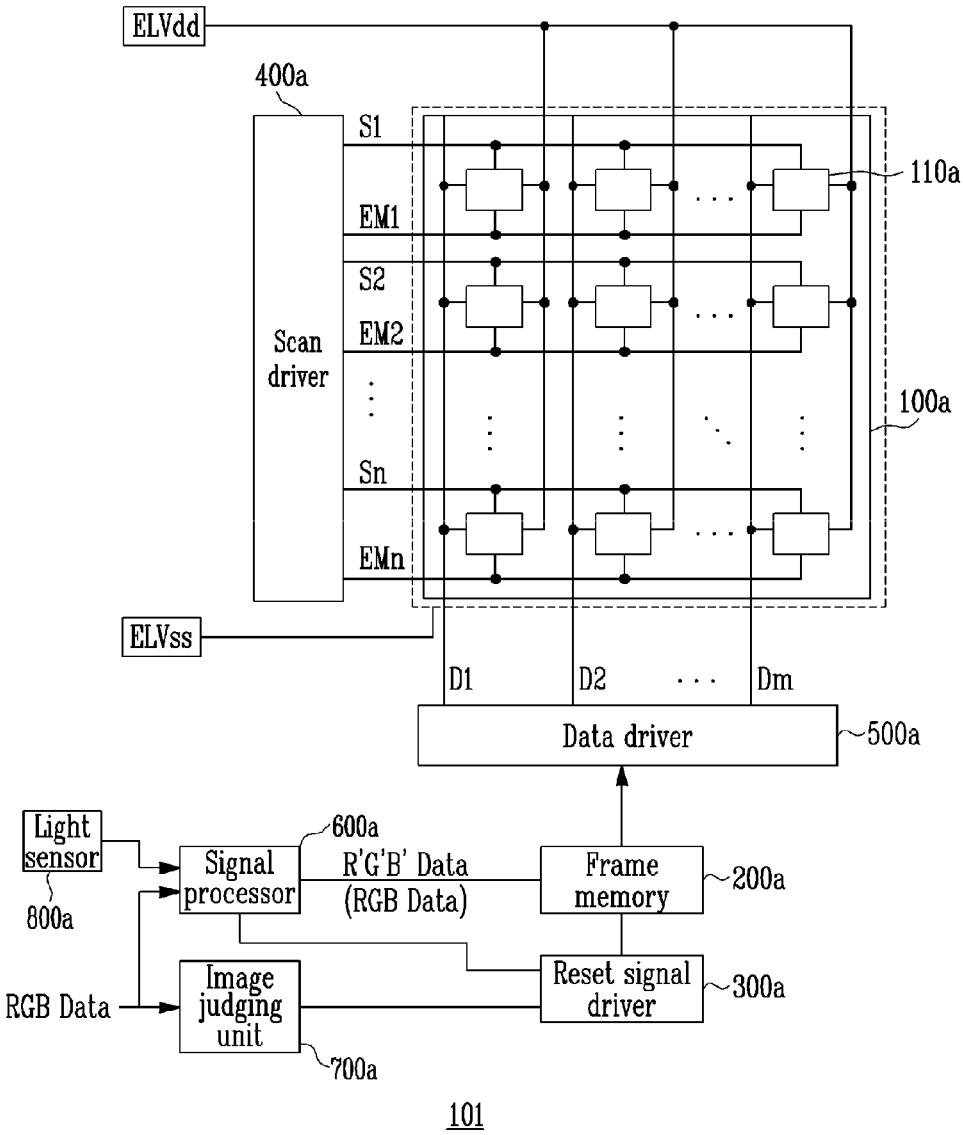
FIG. 1 is a block diagram showing the components of an organic light emitting display device, according to an exemplary embodiment of the present invention.

Reference will now be made in detail to the exemplary embodiments of the present invention, examples of which are illustrated in the accompanying drawings, wherein like reference numerals refer to the like elements throughout. The exemplary embodiments are described below, in order to explain the present invention, by referring to the figures. As referred to herein, when a first element is described as being coupled to a second element, the first element may be not only directly coupled to the second element, but may also be indirectly coupled to the second element, via one or more intervening elements. Further, elements that are not essential to the complete understanding of the invention are omitted for clarity. Also, like reference numerals refer to like elements throughout.

FIG. 1 is a block diagram showing components of an organic light emitting display device 101, according to an exemplary embodiment of the present invention. Referring to FIG. 1, the organic light emitting display device 101 includes a pixel unit 100*a*, a frame memory 200*a*, a reset signal driver 300*a*, a scan driver 400*a*, a data driver 500*a*, a signal processor 600*a*, an image judging unit 700*a*, and a light sensor 800*a*.

The pixel unit 100*a* includes a plurality of pixels 110*a* coupled to scan lines S1 to Sn and data lines D1 to Dm. Herein, each pixel 110*a* includes one organic light emitting diode, and can include at least two sub-pixels that emit different wavelengths (colors) of light.

The pixel unit 100*a* displays an image corresponding to an external first power supply ELVdd, an external second power supply ELVss, scan signals supplied from a scan driver 400*a*, and data signals supplied from a data driver 500*a*.

The frame memory 200*a* receives and stores image data from the signal processor 600*a*, and transfers the stored image data to the data driver 500*a*. The frame memory 200*a* stores the image data in units corresponding to one frame. The image data can include RGB data, and can be referred to as RGB Data.

The reset signal driver 300*a* transfers reset signals to the frame memory 200*a*, to delete the image data stored in the frame memory 200*a*, and transfers new image data to the frame memory 200*a* for storage. The reset signal driver 300*a* receives image judging signals from the image judging unit 700*a*, and selection signals generated from a signal processor 600*a* The reset signal driver 300*a* generates the reset signals, according to the voltages of the image judging signals which indicate still images, and the selection signals indicating the case where a modification of the image data is needed.

The scan driver 400*a* generates the scan signals, which are sequentially supplied to each of the scan lines S1 to Sn. The data driver 500*a* receives image data converted by the signal processor 600*a*, to generate corresponding data signals. The data signals generated by the data driver 500*a* are supplied to the data lines D1 to Dm, in synchronization with the scan signals that are in turn supplied to each pixel 110*a*.

The signal processor 600*a* compares light sensing signals Ssens, input from the light sensor 800*a*, with preset reference values, to generate the selection signals. The selection signals are to select any one of at least two modes. The signal processor 600*a* determines a modification of the image data, according to the generated selection signals. In other words, the signal processor 600*a* determines whether to modify the image data, by using the selection signals. Herein, the modified image data can be referred to as changed image data, or modified R'G'B' Data. The signal processor 600*a* generates and stores the modified R'G'B' Data, which relates to a change in the brightness and/or saturation values of the RGB Data. The modified R'G'B' Data, or the RGB Data, stored in the signal processor 600*a*, is input to the frame memory 200*a*.

The image judging unit 700*a* judges whether frames of the input video data relate to still images or moving images, to generate the image judging signals Vs. The image judging unit 700*a* outputs the image judging signals Vs to the signal processor 600*a*. The image judging unit 700*a* judges whether the frames of the input video data relate to still images or moving images, through the following methods.

The image judging unit 700*a* determines whether frames of the video data relate to still images or moving images, according to a difference between the video data input in one frame, and the video data input in a subsequent frame. Alternatively, the video data can be encoded with movement data, and the image judging unit can use the movement data to determine whether the video data relates to still images or moving images.

In the case of the moving images, since the image data stored in the frame memory is changed for each frame unit, modified image data is input when the external light is changed, such that the image data is modified in the signal processor, and then the modified image data is transferred to the frame memory. As a result, the image data is changed according to the external light, so that the visibility of the image data is improved.

In the case of the still images, the image data is not changed after it is stored in the frame memory, even when the luminance of the external light is changed. Since the image data is not changed, the visibility of the image data is not improved. In order to improve the visibility of the still images, the image judging unit 700*a* judges whether the video data relates to still images or moving images, and in the case of still images, generates reset signals to store modified image data in the frame memory. Before the modified image data is stored in the frame memory; the image data stored in the signal processor 600*a* is modified by the signal processor, and then the modified image data is transferred to the frame memory.

The light sensor 800*a* generates the light sensing signals, and transfers the light sensing signals to the signal processor. The light sensing signals correspond to the light intensity of an external environment of the display device 101.

Figure 2:
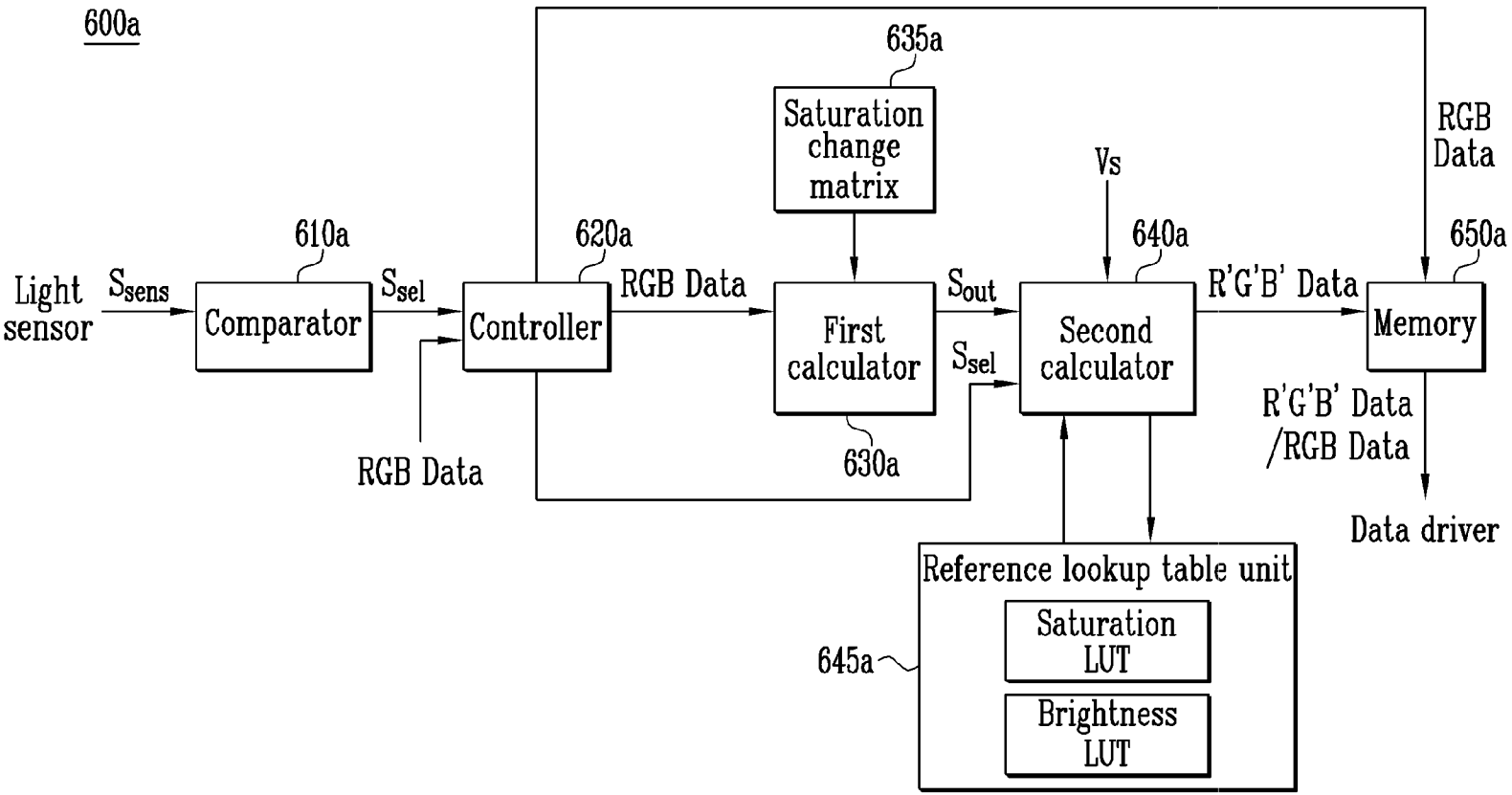
FIG. 2 is a block diagram showing the structure of a signal processor, adopted in the organic light emitting display device shown in FIG. 1.

FIG. 2 shows the structure of a signal processor 600*a*, adopted in the organic light emitting display device 101. Referring to FIG. 2, the signal processor 600*a* includes a comparator 610*a*, a controller 620*a*, a first calculator 630*a*, a saturation change matrix 635*a*, a second calculator 640*a*, a reference lookup table unit 645*a*, and a memory 650*a*.

The comparator 610*a* compares the light sensing signals Ssens supplied from the light sensor 800*a*, with preset reference values, to output selection signals Ssel. The selection signals Ssel designate one of at least two modes. More specifically, the comparator 610*a* determines the modes, based on preset reference values, corresponding to the magnitude of the light sensing signals Ssens, and outputs the corresponding selection signals Ssel. For convenience, it is assumed that the comparator 610*a* establishes two modes corresponding to the light sensing signals Ssens. The modes can relate to changes in pixel saturation and/or luminance modifications of the image data (RGB Data).

For example, if the light sensing signals Ssens are within a lower range of values, of the preset reference values, that is, if the external light intensity is low, the comparator 610*a* establishes a first mode that does not change the RGB Data, and outputs the corresponding selection signals Ssel. If the light sensing signals Ssens are in a higher range of values, of the preset reference values, that is, the external light intensity is in high (directly incident sunlight), the comparator 610*a* establishes a second mode that maximally changes the saturation and/or brightness of the RGB Data, and outputs the corresponding selection signals Ssel. The selection signals Ssel output from the comparator 610*a* are input to the controller 620*a*.

The controller 620*a* determines whether the RGB Data is to be modified, by analyzing the selection signals Ssel input from the comparator 610*a*. The controller 620*a* transfers the RGB Data to the first calculator 630*a*, or stores the image RGB Data in the memory 650*a*, according to whether the RGB Data is to be modified. For example, the controller 620*a* stores the RGB Data in the memory 650*a*, when the external light intensity, as determined from the selection signals Ssel, is low, that is, when the selection signals Ssel corresponding to the first mode are supplied.

When the external light intensity is high, that is, the selection signals Ssel corresponding to the second mode are supplied, the controller 620*a* transfers the RGB Data to the first calculator 630*a*, and transfers the input selection signals Ssel to the second calculator 640*a*. The first calculator 630*a* refers to the saturation change matrix 635*a*, to generate pixel saturation data Sout, corresponding to the RGB Data transferred from the controller 620*a*. For example, the first calculator 630*a* uses the saturation change matrix 635*a*, and input data Rin, Gin, and Bin (per sub-pixel) included in the RGB Data, to calculate target saturation data Rs, Gs, and Bs (per sub-pixel). The first calculator 630*a* uses the target saturation data Rs, Gs, and Bs to generate the pixel saturation data Sout.

The target saturation data Rs, Gs, and Bs (per sub-pixel) can be calculated from the saturation change matrix 635a. A method of calculating the target saturation data Rs, Gs, and Bs, will be described below, with reference to FIGS. 5A to 5D.

The pixel saturation data Sout is calculated using the target saturation data Rs, Gs, and Bs. For example, the pixel saturation data Sout can be set to a maximum value, of the target saturation data values Rs, Gs, and Bs, or to a predetermined value corresponding to the difference between the maximum value and a minimum value of the target saturation data values Rs, Gs, and Bs. The pixel saturation data Sout, generated by the first calculator 630*a*, is supplied to the second calculator 640*a*.

The second calculator 640*a* extracts the modified R'G'B' Data, from the reference lookup table unit 645*a*, by using the pixel saturation data Sout and the selection signals Ssel. The pixel saturation data Sout, and the selection signals Ssel, are respectively supplied from the first calculator 630*a* and the controller 620*a*. The second calculator 640*a* stores the modified R'G'B' Data in the memory 650*a*. More specifically, the second calculator 640*a* selects a saturation and brightness lookup table LUT, from a plurality of saturation and brightness tables included in the reference lookup table unit 645*a*, to extract the modified R'G'B' data. The second calculator 640*a* extracts the modified R'G'B' Data, having the saturation and brightness values corresponding to the pixel saturation data Sout, from the selected lookup table. Herein, each of the saturation lookup table and the brightness lookup table refers to a table referenced to extract the saturation change values and the brightness change values, corresponding to the pixel saturation data Sout.

The memory 650*a* stores the RGB Data transferred from the controller 620*a*, or the modified R'G'B' Data supplied from the second calculator 640*a*. The RGB Data or the modified R'G'B' Data, are output from the memory 650*a* to the data driver 500*a*.

Figure 3:
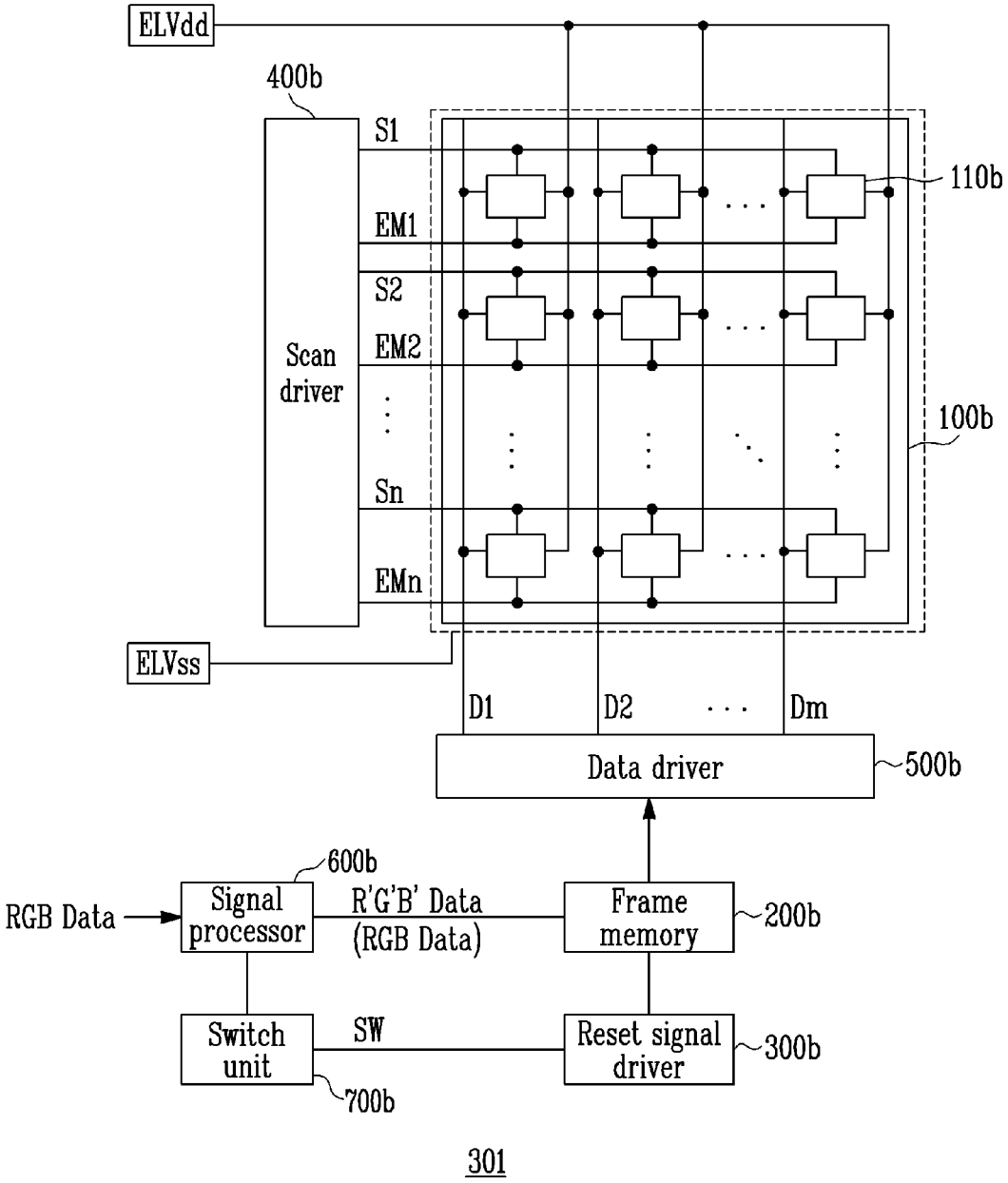
FIG. 3 is a block diagram showing the components of an organic light emitting display device, according to an exemplary embodiment of the present invention.

FIG. 3 is a block diagram showing an organic light emitting display device 301, according to an exemplary embodiment of the present invention. Referring to FIG. 3, the organic light emitting display device 301 includes a pixel unit 100*b*, a frame memory 200*b*, a reset signal driver 300*b*, a scan driver 400*b*, a data driver 500*b*, a signal processor 600*b*, and a switch unit 700*b*.

The pixel unit 100*b* includes a plurality of pixels 110*b*, coupled to scan lines S1 to Sn and data lines D1 to Dm. Each pixel 110*b* includes one organic light emitting diode that can include at least two sub-pixels that emit different wavelengths (colors) of light. The pixel unit 100*b* displays an image corresponding to a first power supply ELVdd, a second power supply ELVss, scan signals supplied from the scan driver 400*b*, and data signals supplied from the data driver 500*b*.

The frame memory 200*b* receives and stores image data from the signal processor 600*b*, and transfers the stored image data to the data driver 500*b*. The frame memory 200*b* stores the image data in units corresponding to one frame.

The reset signal driver 300*b* transfers reset signals to the frame memory 200*b*, to delete the image data stored in the frame memory, and transfers new image data to the frame memory 200*b* for storage. The reset signals are generated by receiving switching signals sw transferred from the switch unit 700*b*.

The scan driver 400*b* generates the scan signals, and sequentially supplies the scan signals to each of the scan lines S1 to Sn. The data driver 500*b* receives the image data converted by the signal processor 600*b*, to generate corresponding data signals. The data signals generated by the data driver 500*b* are supplied to the data lines D1 to Dm in synchronization with the scan signals, which are in turn supplied to each pixel 110*b*.

The signal processor 600*b* receives the switching signals from the switch unit 700*b*, and modifies the image RGB Data, according to the generated selection signals. The signal processor 600*b* generates and stores the modified R'G'B' Data, which relates to modifications in the brightness and/or saturation values of the RGB Data. The modified R'G'B' Data or the RGB Data, stored in the signal processor 600*b*, is input to the frame memory 200*b*.

The switch unit 700*b* generates the switching signals, according to a user input. If the user judges that the images are poorly displayed, due to strong external light, the user generates the switching signals, by operating the switch unit 700*b*. Therefore, the judgment as to whether the input images are moving images or still images is not needed.

Figure 4:
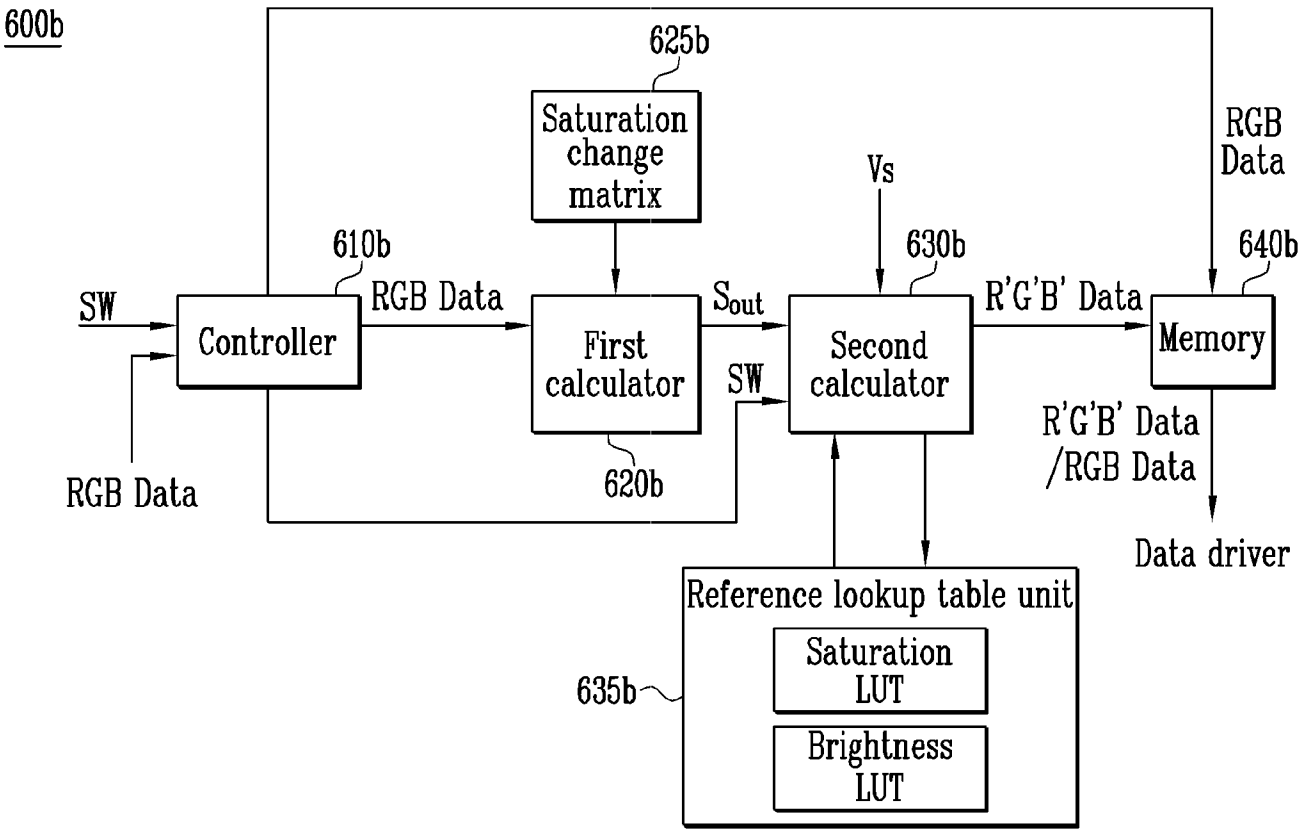
FIG. 4 is a block diagram showing the structure of a signal processor, adopted in the organic light emitting display device shown in FIG. 3.

FIG. 4 shows a signal processor 600*b* adopted in the organic light emitting display device 301, shown in FIG. 3. Referring to FIG. 4, the signal processor 600*b* includes a controller 610*b*, a first calculator 620*b*, a saturation change matrix 625*b*, a second calculator 630*b*, a reference lookup table unit 635*b*, and a memory 640*b*.

The controller 610*b* determines whether the RGB Data is to be modified, according to the switch signals sw input from the switch unit 700*b*. If the RGB data is to be modified, the controller 610*b* transfers the RGB Data to the first calculator 620*b*. If the RGB data is not to be modified, the controller 610*b* stores the RGB Data in the memory 640*b*. For example, the controller 610*b* stores the RGB Data in the memory 640*b*, when the switch signals sw are not output thereto. When the switch signals sw are output to the controller 610*b*, the controller 610*b* outputs the RGB Data to the first calculator 620*b*, and outputs the input switch signals sw to the second calculator 630*b*.

The first calculator 620*b* refers to the saturation change matrix 625*b*, to generate pixel saturation data Sout, corresponding to the RGB Data transferred from the controller 610*b*. For example, the first calculator 620*b* calculates the saturation change matrix 625*b*, and input data Rin, Gin, and Bin (per sub-pixel) included in the RGB Data, to yield target saturation data Rs, Gs, and Bs (per sub-pixel). The first calculator 620*b* uses the target saturation data Rs, Gs, and Bs to generate the pixel saturation data Sout.

Herein, the target saturation data Rs, Gs, and Bs can be yielded (calculated) using the saturation change matrix 625*b*. A method of yielding the target saturation data Rs, Gs, and Bs, will be described below with reference to FIGS. 5A to 5D.

The pixel saturation data Sout is calculated from the target saturation data Rs, Gs, and Bs. For example, the pixel saturation data Sout can be set to the maximum value of the target saturation data values Rs, Gs, and Bs, or to a predetermined value corresponding to the difference between the maximum value and minimum value of the target saturation data values Rs, Gs, and Bs.

The pixel saturation data Sout is supplied to the second calculator 630*b*. The second calculator 630*b* extracts the modified R'G'B' Data, from the reference lookup table unit 635*b*, corresponding to the pixel saturation data Sout and the selection signals Ssel, supplied from each of the first calculator 620*b* and the controller 610*b*. The second calculator 630*b* stores the pixel saturation data Sout, and the selection signals Ssel, in the memory 640*b*.

More specifically, the second calculator 630*b* selects a saturation and brightness lookup table LUT, included in the reference lookup table unit 635*b*, to extract the modified R'G'B' data. The second calculator 630*b* extracts the modified R'G'B' Data, having saturation and brightness values corresponding to the pixel saturation data Sout, from the selected lookup table.

Herein, each of the saturation lookup table and the brightness lookup table, refers to a table referenced to extract the saturation change values and the brightness change values, which correspond to the pixel saturation data Sout.

The memory 640*b* stores the RGB Data transferred from the controller 610*b*, or the modified R'G'B' Data supplied from the second calculator 630*b*. The RGB Data or the modified R'G'B' Data is input to the data driver 500*b*.

FIGS. 5A to 5D show target saturation data per sub-pixel, using the saturation change matrixes 635*a* and 625*b*, shown in FIGS. 2 and 4. Referring to FIGS. 5A to 5D, the first calculators 630*a* and 620*b* multiply the saturation change matrixes 635*a*, 625*b*, and saturation change matrix A, by the input data Rin, Gin, and Bin (per sub-pixel included in the RGB Data), so that the target saturation data Rs, Gs, and Bs (per sub-pixel) can be yielded (FIG. 5A).

The saturation change matrix A is a matrix having saturation values, according to a saturation factor k that determines the saturation control. The saturation change matrix A is used for yielding the target saturation data Rs, Gs, and Bs, by converting the input data Rin, Gin, and Bin, using the values of the saturation factor k.

The saturation change matrix A is set according to a white balance of a pixel, and generally includes the matrix as shown in FIG. 5B. In other words, the first calculator 620*b* multiplies the saturation change matrix A, shown in FIG. 5B, by the input data Rin, Gin, and Bin, so that the target saturation data Rs, Gs, and Bs can be yielded.

If the value of the saturation factor k is larger than 1, the saturation is increased. If the value of the saturation factor is smaller than 1, the saturation is reduced. If the value of the saturation factor k is equal to 1, the saturation change matrix A is a unit matrix of 3×3, so that the saturation is not changed (FIG. 5C). If the value of the saturation factor k is 0, as shown in FIG. 5D, all of the target saturation data Rs, Gs, and Bs are set to be equal to the white balance ratio, i.e., changed into a gray image.

The organic light emitting display device, according to the present teachings, has an improvement of visibility, and a reduction of power consumption, by changing image data according to an external light intensity.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic light emitting display device, comprising:

a display unit including scan lines to transfer scan signals, data lines to transfer data signals, and pixels to represent image data organized in frames, the pixels being coupled to the scan lines and the data lines;

a light sensor to generate light sensing signals corresponding to an external light intensity of an environment of the display device;

an image judging unit to generate image judging signals, according to whether subsequent frames of the image data relate to moving images or still images, the image judging unit being configured to generate the image judging signals only if the image data corresponds to the still images;

a signal processor to compare the light sensing signals with reference values to generate selection signals, and to modify the image data according to the selection signals;

a frame memory to store the modified image data output from the signal processor, the frame memory being configured to store the modified image data in units corresponding to one of the frames, not change corresponding modified image data of the subsequent frames of the image data when the subsequent frames relate to the still images, and reload the frame memory from the signal processor output after a reset of the frame memory;

a reset signal driver to generate reset signals to reset the frame memory, according to the image judging signals and the selection signals;

a scan driver to generate the scan signals, and to sequentially output the scan signals to the scan lines; and a data driver to generate the data signals, and to output the data signals to the data lines.

2. The organic light emitting display device as claimed in claim 1, wherein the signal processor comprises:

a comparator to compare the light sensing signals with the reference values, and to generate the selection signals, which relate to one of at least two modes, according to the comparison;

a first calculator to generate pixel saturation data corresponding to the image data;

a second calculator to modify the image data, according to the pixel saturation data and the selection signals; and a memory to store the image data or the modified image data; and a controller to control the first calculator, the second calculator, and the memory, and to output the image data to the first calculator or the memory, according to the selection signals.

3. The organic light emitting display device as claimed in claim 2, further comprising a saturation change matrix that is referenced by the first calculator to generate the pixel saturation data.

4. The organic light emitting display device as claimed in claim 3, wherein:

the pixels comprise sub-pixels;

the first calculator uses the saturation change matrix and sub-pixel data of the image data, to calculate target saturation data; and the first calculator generates the pixel saturation data using the target saturation data.

5. The organic light emitting display device as claimed in claim 4, wherein the first calculator calculates the target saturation data with respect to each of the sub-pixels.

6. The organic light emitting display device as claimed in claim 2, further comprising a reference lookup table comprising a first saturation and brightness lookup table that is referenced by the second calculator to modify the image data.

7. The organic light emitting display device as claimed in claim 2, wherein the image data is output from the controller to the first calculator, and then to the second calculator, or from the controller to the memory.

8. The organic light emitting display device as claimed in claim 2, wherein the modified image data is output from the second calculator to the memory.

9. The organic light emitting display device as claimed in claim 1, wherein the signal processor modifies pixel saturation and/or brightness values of the image data, with respect to each of the pixels.

10. A driving method of an organic light emitting display device comprising a signal processor for modifying image data organized in frames, the method comprising:

generating scan signals and sequentially outputting the scan signals to scan lines;

generating data signals and outputting the data signals to data lines;

generating light sensing signals corresponding to an external light intensity of an environment of the display device;

storing modified image data output from the signal processor in a frame memory configured to store the image data in units each corresponding to one of the frames, the image data comprising first image data in a first one of the frames that relates to a still image;

generating image judging signals according to whether subsequent ones of the frames of the image data relate to moving images or still images, comprising generating the image judging signals only if the image data corresponds to the still images;

generating selection signals by comparing the light sensing signals with reference values, modifying the image data according to the selection signals, and outputting the selection signals and the modified image data from the signal processor;

not changing the first image data in the frame memory, of the subsequent ones of the frames of the image data, when the subsequent ones of the frames relate to the still image;

reloading the frame memory from the signal processor output after a reset of the frame memory;

resetting the frame memory to erase the first image data in the frame memory in a second one of the frames that relates to the still image; and storing modified first image data in the second one of the frames, wherein the modified first image data corresponds to the first image data, and comprises modified pixel saturation and/or brightness values of the first image data.

11. The method as claimed in claim 10, wherein the modified first image data is produced according to a signal output from a light sensor, according to a luminance of an environment in which the display device is disposed.

12. The method as claimed in claim 10, wherein the modified first image data is produced according to a signal output from an image judging unit, when the image judging unit determines that the image data relates to the still image.

* * * * *